US008146202B2

(12) United States Patent
Curtis

(10) Patent No.: US 8,146,202 B2
(45) Date of Patent: Apr. 3, 2012

(54) RUG ANTI-SLIP DEVICE

(76) Inventor: Doug Curtis, Yuma, AZ (US)

( * ) Notice: Subject to any disclaimer, the term of this patent is extended or adjusted under 35 U.S.C. 154(b) by 198 days.

(21) Appl. No.: 12/688,111

(22) Filed: Jan. 15, 2010

(65) Prior Publication Data

US 2011/0173774 A1 Jul. 21, 2011

(51) Int. Cl.
*A47G 27/04* (2006.01)

(52) U.S. Cl. ..... 16/4

(58) Field of Classification Search ..... 16/4, 6, 16/8, 17.1; 24/90.1, 55, 60, 63, 314, 350, 24/351, 354–357, 380; 40/1, 1.5, 1.6, 586, 40/661.04, 661.11, 662; 428/53, 61, 62, 428/99, 100, 223
See application file for complete search history.

(56) References Cited

U.S. PATENT DOCUMENTS 287,990 A * 11/1883 Allen ..... 16/8
363,399 A 5/1887 Kilmer
518,193 A * 4/1894 Korb et al. ..... 16/6
581,634 A 4/1897 Veal
778,287 A 12/1904 Van Buren
1,312,323 A 8/1919 Hannah
1,645,499 A * 10/1927 Fenton ..... 24/356
1,645,500 A * 10/1927 Fenton et al. ..... 24/356
1,649,766 A * 11/1927 Boden ..... 24/356
1,649,767 A * 11/1927 Chapman ..... 24/356
1,649,768 A * 11/1927 Goss ..... 24/356
1,692,778 A * 11/1928 King ..... 24/356
1,980,758 A * 11/1934 Komorous ..... 40/307
4,033,012 A * 7/1977 Kramer et al. ..... 24/114.05
4,901,961 A * 2/1990 Gish ..... 248/217.2
5,003,664 A 4/1991 Wong ..... 16/6
5,014,390 A * 5/1991 De Gastines ..... 16/4
5,067,265 A * 11/1991 Harms ..... 40/1.5
2009/0269546 A9 * 10/2009 Alford ..... 428/99

* cited by examiner

*Primary Examiner* — Chuck Y. Mah
(74) *Attorney, Agent, or Firm* — Steins & Associates, P.C.

(57) ABSTRACT

A Rug Anti-slip Device. The device includes a pin-shaped element that has a sharpened tip end for poking through a mat and into the underlying carpet. The device further has a handle tab made from plastic or other suitably durable and aesthetically pleasing material. The handle tab is designed to stay above the surface of the mat or rug when the pin-shaped element is holding the mat or rug in place. The upper face of the handle tab may have indicia inscribed upon it, or embossed/raised above it in order to provide a decorative aspect to the device beyond the utilitarian purpose of holding the mat or rug in place.

17 Claims, 5 Drawing Sheets

RUG ANTI-SLIP DEVICE

BACKGROUND OF THE INVENTION

1. Field of the Invention

This invention relates generally to floor coverings and accessories therefore and, more specifically, to a Rug Anti-slip Device.

2. Description of Related Art

There have been several attempts at solving the problem of holding mats or rugs in place atop a carpeted floor area. Dichtel, U.S. Pat. No. 4,860,402, for a "Carpet Mat Retainer Clip" discloses a metallic, spring-like clip that grasps the edge of the rug and holds that rug edge to the carpet.

U.S. Pat. No. 1,598,127 to J. G. Fleming discusses a "Corner Piece for Rugs" that is designed to prevent the corners of a rug from curling up when the rug is placed atop a polished floor surface, like a hardwood floor.

The "Automobile Mat and Securing Clip" device awarded U.S. Pat. No. 5,003,664 to Wong is a metallic pin that pins through the carpet surface. Cooperating sections of hook-and-loop fastener material on the top surface of the Wong clip and the bottom surface of the automobile mat releasibly attach to one another in order to hold the mat in its desired location.

U.S. Pat. No. 581,634 to I. N. Veal for a "Rug Fastener" is a two-piece pin/clip assembly that pins through the carpet and then clips to a device attached to the underside of the rug.

The "Carpet Fastener" of N. M. Harrison, U.S. Pat. No. 493,401 is, essentially, a specialized safety pin that pins through the rug and carpet and then attaches to itself (to safely protect the protruding pin tip).

Finally, the "Rug Anchor" of U.S. Pat. No. 5,761,765 to Fuzzell is a device having upwardly-turned teeth and downwardly-turned teeth on its respective top and bottom surfaces. The Fuzzell device is placed between the rug and carpet and the teeth engage both to keep the rug from moving.

While each of these devices may serve the purposes that their respective inventors sought to serve, that is to prevent movement of a rug, none seems to have achieved any real penetration into the market. It is believed that this is because they each suffer from one of the following problems: (1) too expensive to make; (2) difficult to install; (3) not durable enough for long-term installations; (4) none actually adds to the aesthetics of the rug or mat; or (5) safety issues related to their use.

The device of the present invention succeeds where these prior devices fail, and, as discussed herein, does not suffer from any of the itemized problems.

SUMMARY OF THE INVENTION

In light of the aforementioned problems associated with the prior devices, it is an object of the present invention to provide a Rug Anti-slip Device. The device should include a pin-shaped element that has a sharpened tip end for poking through a mat and into the underlying carpet. The device should further have a handle tab made from plastic or other suitably durable and aesthetically pleasing material. The handle tab should be designed to stay above the surface of the mat or rug when the pin-shaped element is holding the mat or rug in place. The upper face may have indicia inscribed upon it, or embossed/raised above it in order to provide a decorative aspect to the device beyond the utilitarian purpose of holding the mat or rug in place.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Rug Anti-slip Device.

Figure 1:
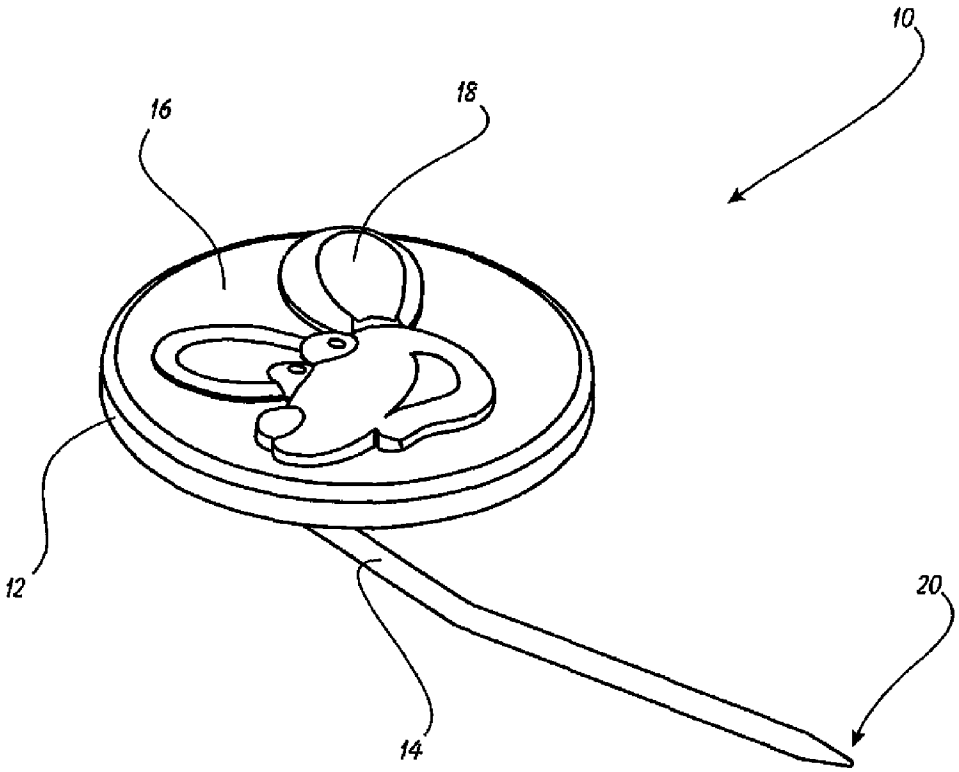
FIG. 1 is a perspective view of a preferred embodiment of the mg anti-slip device of the present invention.

The present invention can best be understood by initial consideration of FIG. 1. FIG. 1 is a perspective view of a preferred embodiment of the rug anti-slip device 10 of the present invention. The device 10 has two major components: the handle tab 12 and the pin portion 14. The handle tab 12 generally is defined by a face 16 from which an indicia element 18 may be imprinted upon or raised therefrom. The pin portion 14 terminates at its furthest end by a pointed tip 20. In this current embodiment of the device 10, the indicia 18 is the shape of a rat's head. In this version, that indicia 18 serves to promote the brand name of the device 10. In other versions other indicia 18 could be other shapes or messages.

Figure 2:
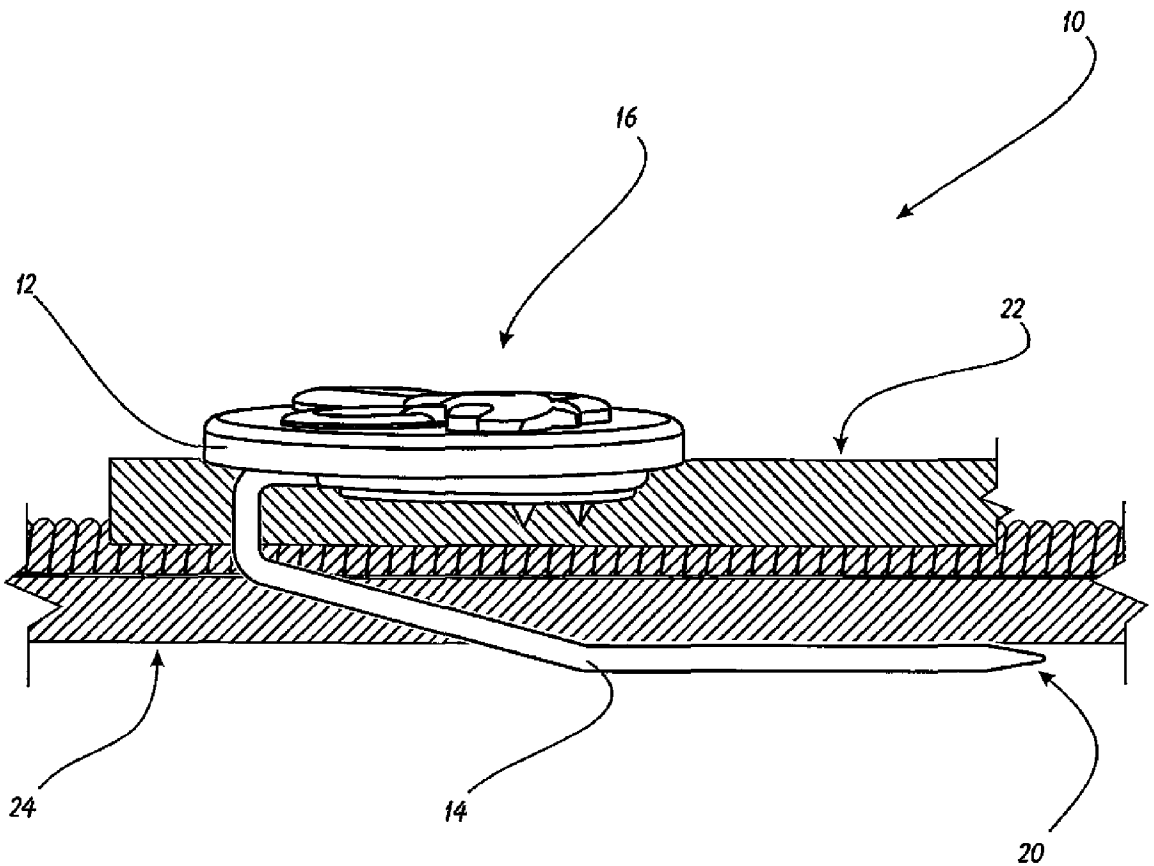
FIG. 2 is a side view of the device of FIG. 1 in use.

If we now turn to FIG. 2, we can continue to explore the value of this new device. FIG. 2 is a side view of the device of FIG. 1 in use. As shown here, the device 10 is designed to pin through the mat 22 and into the carpet 24. The benefit of this design is that the device 10 can be placed anywhere on the mat, either at the edges or even in the center, depending on the size of the mat 22 or the location of the mat 22 on the carpet 24 in the traffic pattern.

Figure 3:
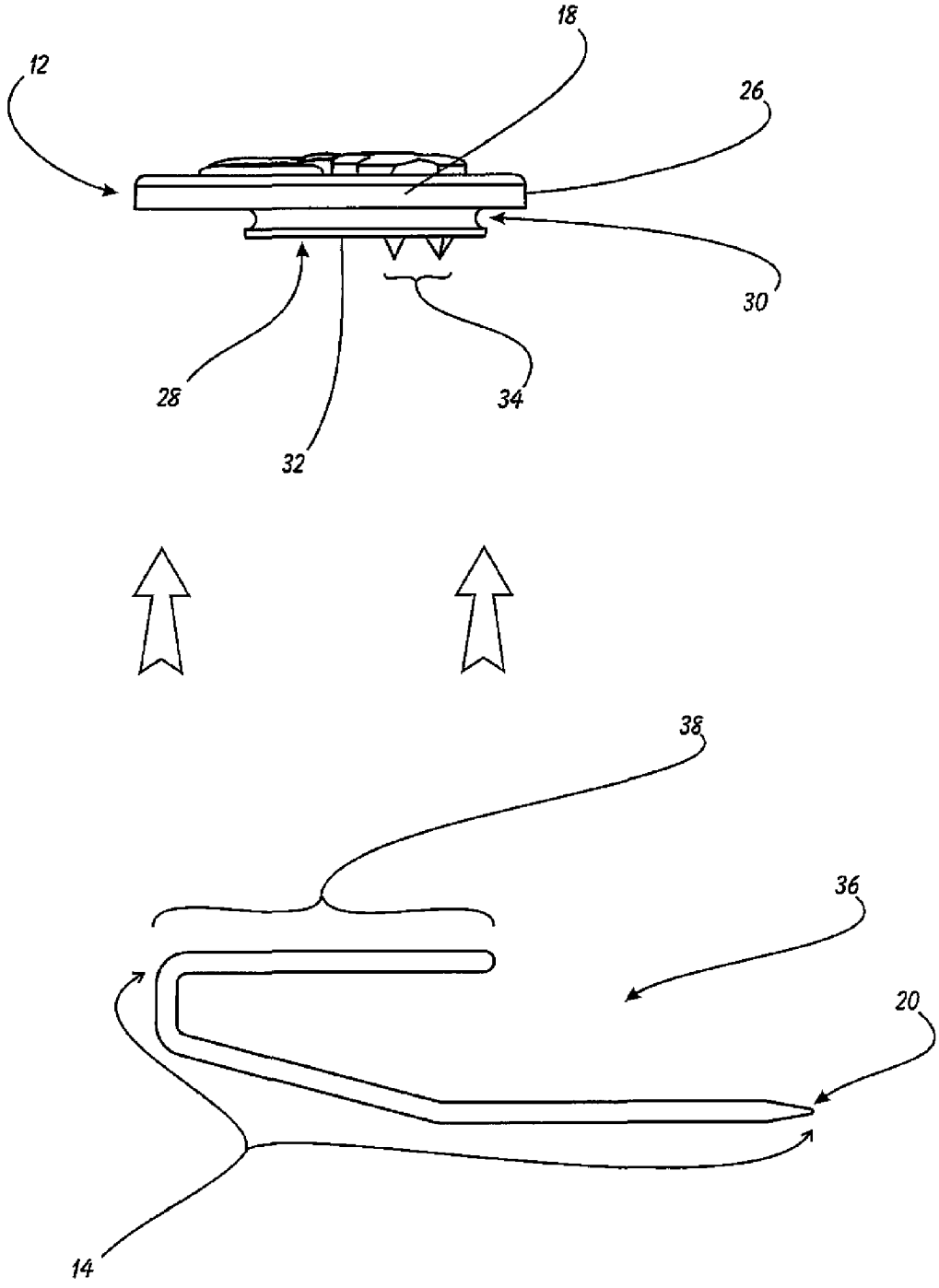
FIG. 3 is an exploded side view of the device of FIGS. 1 and 2.

The pin portion 14 penetrates the mat 22 and into the carpet 24. This is aided by the sharpened tip 20, as shown here. When it is fully installed, the handle tab 12 continues to sit atop the mat 22 which makes it easy to grasp either for installation or removal. It should also be clear the face 16 is clearly visible and, therefore, becomes an aesthetic part of the mat 22 and the carpet 24. FIG. 3 provides additional detail.

FIG. 3 is an exploded side view of the device of FIGS. 1 and 2. The handle tab 12 in this version is made from a molded plastic. Plastic is used because it is highly durable and can be painted or made from a colored material. This gives a virtually unlimited variety of options to the manufacturer in creating a highly durable and very inexpensively made product. The tab 12 is defined by a base portion 26, which in this version is flat and generally circular in shape, but may be in other shapes for other versions.

There is an attachment hub 28 extending downwardly from the backside of the base portion 26. The attachment hub is defined by a hub face 32 from which a series of teeth 34 extend downwardly. The teeth 34 serve to bite into the top surface of the mat 22 (see FIG. 2) in order to prevent the device 10 from being inadvertently kicked aside or from slipping loose. The groove 30 formed at the perimeter of the attachment hub 28 is provided as an interface location for the attachment loop 38 of the wire member 36. The wire member 36 is made from high-strength metallic material that preferably provides some spring tension to prevent it from being deformed while in use. As such, the attachment loop 38 can have an interference fit with the groove 30 of the attachment hub 28, so that when it is snapped over the attachment hub, the loop 38 will continue to be snugly captured within the groove 30. The pin portion 14 extends downwardly from the attachment loop 38. As discussed above and depicted in FIG. 2, that pin portion 14 is the section of the wire member 36 that penetrates the mat and the carpet.

Figure 4B:
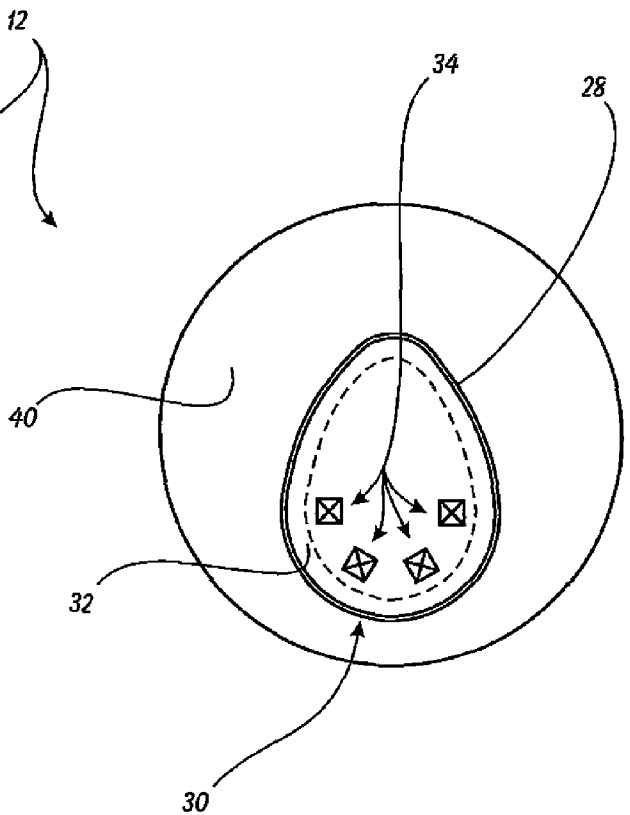
FIGS. 4A and 4B are top and back views, respectively, of the handle tab of the device of FIGS. 1-3.
Figure 4A:
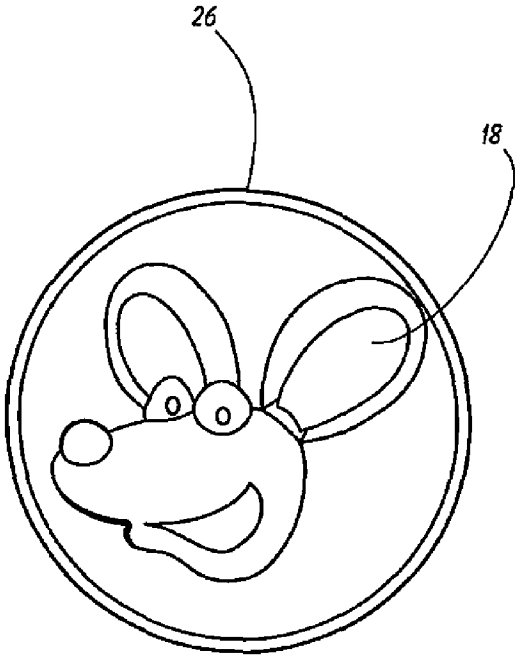

If we now turn to FIGS. 4A and 4B we can examine the handle tab in additional detail. FIGS. 4A and 4B are top and back views, respectively, of the handle tab of the device of FIGS. 1-3. The handle tab 12 as discussed above is defined by a generally circular base portion 26 from which the rat head raised indicia 18 protrudes. In this version, the circular base portion 26 was chosen for the purposes of flexibility but is by no means intended to limit the options available to the manufacturer. The attachment hub 28 extends from the rear face 40 of the base. As shown here, there are four teeth 34 that extend from the face of the hub 32. The inner perimeter of the groove 30 is shown here by a dashed line. The attachment hub 28 has a teardrop shape to it. The intent behind this shape is to prevent the wire member (see FIG. 3) from twisting with respect to the handle tab 12. Other shapes may be used such as triangular or square or other polygon; however, it is unlikely that the manufacturer would ever choose that the attachment hub 28 be circular.

Figure 5B:
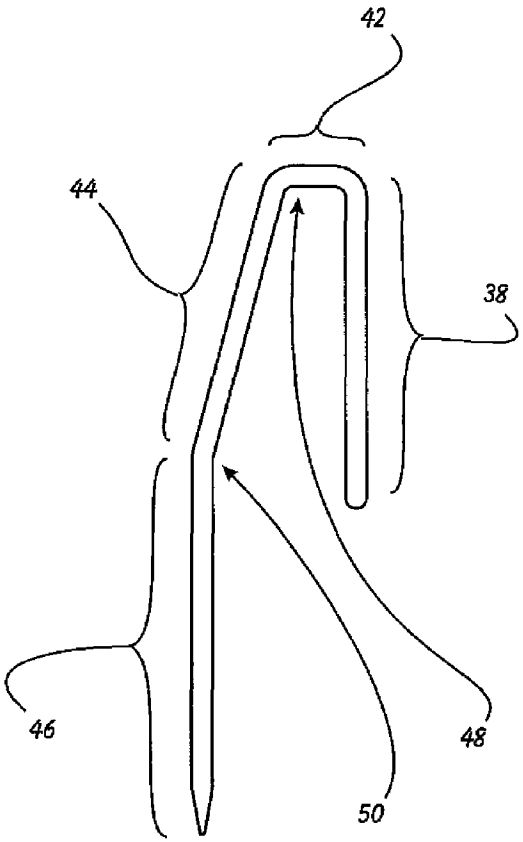
FIGS. 5A and 5B are top and side views, respectively, of the pin portion of the device of FIGS. 1-3.
Figure 5A:
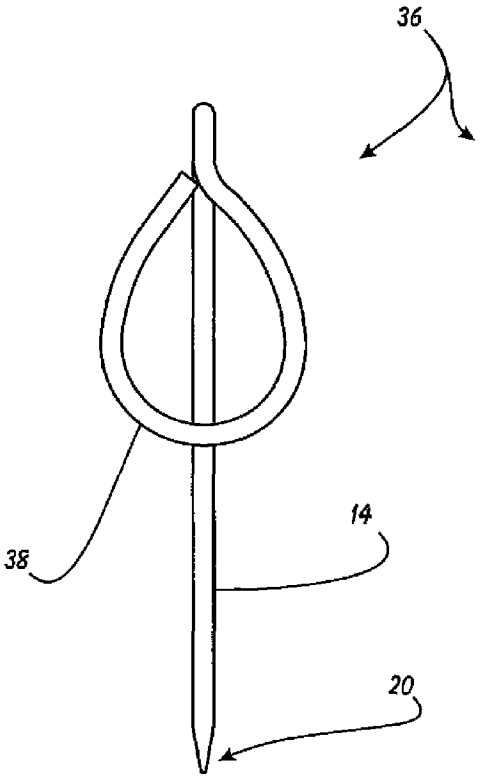

Finally, we turn to FIGS. 5A and 5B. FIGS. 5A and 5B are top and side views, respectively, of the pin portion of the device of FIGS. 1-3. The wire member 36 has a teardrop-shaped attachment loop 38 and a pin portion 14 terminating in a tip 20. As shown in FIG. 5B, the pin portion in this version is defined by a proximal leg 42 that extends downwardly from the attachment loop 38. The proximal leg 42 then transitions to the medial leg 44. The medial leg 44 is separated from the proximal leg 42 by the first bend 48. In this case, the first bend 48 is approximately 110 degrees because it provides a suitable declination angle for the medial leg as compared to the attachment loop 38. This facilitates the insertion of the wire member 36 into the rug and carpet and then holding it snugly in place. The pin portion 14 terminates in the distal leg 46, which is separated from the medial leg 44 by a second bend 50. The angle of second bend 50 cooperates with the angle of first bend 48 such that the total is preferably 90 degrees so that the distal leg 46 is perpendicular to the proximal leg 42 which is, in turn, perpendicular to the loop 38. It has been demonstrated in testing that the relationship between these bends 48 and 50 will provide supreme ease in installing the device through a mat and carpet while also holding that device snugly in place.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A rug or mat anti-slip device, comprising:

a generally flat handle tab defining a base portion having a face on a first side and an attachment hub extending from a second side opposing said first side and two or more pointed teeth protruding outwardly from a rear face defined by said attachment hub, said attachment hub rear face opposite said handle tab face; and a pin portion attached to said attachment hub, and defined by a single elongate wire-shaped element terminating in a generally pointed tip, said pin portion further defined by a proximal leg extending from said attachment hub, a medial leg extending from said proximal leg, and a distal leg extending from said proximal leg, with each said leg separated by a bend in said wire-shaped element, with said proximal and medial legs being non-parallel to said attachment hub face and said distal leg being generally parallel to said attachment hub face.

2. The device of claim 1, wherein said handle tab base portion defines said rear face, and said hub defines a hub face, with said hub extending outwardly from said base portion rear face such that said hub face and said base portion rear face are non-coplanar.

3. The device of claim 2, wherein said hub is defined by a grooved wall extending between said base portion rear face and said hub face, said grooved wall extending around the periphery of said attachment hub and defined by a concave groove formed therein.

4. The device of claim 3, wherein said pin portion attaches to said grooved wall of said attachment hub.

5. The device of claim 4, wherein said pin portion is defined by an attachment loop at a first end opposing said generally pointed tip end, said attachment loop sized to cooperate with said grooved wall such that said attachment loop captures said grooved wall therewithin in order to affix said pin portion to said handle tab.

6. The device of claim 5, wherein said bend between said attachment loop and said proximal leg is approximately ninety degrees.

7. The device of claim 5, wherein said bend between said proximal and medial legs is greater than ninety degrees.

8. The device of claim 5, wherein said bend between said medial and distal legs is greater than ninety degrees.

9. A device for affixing a first generally flat member to a second generally flat member when said first generally flat member is laid atop said second generally flat member, comprising:

a generally flat handle tab made from a single solid piece of material, said tab defining a base portion having a face on a first side and an attachment hub extending from a second side opposing said first side and two or more pointed teeth protruding outwardly from a rear face defined by said attachment hub, said attachment hub rear face opposite said handle tab face; and a pin portion attached to said attachment hub, and defined by a single elongate wire-shaped element terminating in a generally pointed tip, said pin portion further defined by a proximal leg extending from said attachment hub, a medial leg extending from said proximal leg, and a distal leg extending from said proximal leg, with each said leg separated by a bend in said wire-shaped element, with said proximal and medial legs being non-parallel to said attachment hub face and said distal leg being generally parallel to said attachment hub face.

10. The device of claim 9, wherein said first side face is defined by indicia extending above said base portion.

11. The device of claim 10, wherein said handle tab base portion defines said rear face, and said hub defines a hub face, with said hub extending outwardly from said base portion rear face such that said hub face and said base portion rear face are generally parallel, but are non-coplanar.

12. The device of claim 11, wherein said hub is defined by a grooved wall extending between said base portion rear face and said hub face, said grooved wall extending around the periphery of said attachment hub and defined by a concave groove formed therein.

13. The device of claim 12, further comprising at least four said teeth protruding from said hub rear face.

14. The device of claim 13, wherein said pin portion attaches to said grooved wall of said attachment hub.

15. The device of claim 14, wherein said pin portion is defined by an attachment loop at a first end opposing said generally pointed tip end, said attachment loop sized to cooperate with said grooved wall such that said attachment loop captures said grooved wall therewithin in order to affix said pin portion to said handle tab.

16. A device for pinning a rug or mat to a carpet, consisting essentially of:

a generally flat handle tab made from a single solid piece of material, said tab defining a base portion having a face on a first side further defined by indicia extending upwardly therefrom, and an attachment hub extending from a second side opposing said first side and defining a hub face said hub face including a plurality of pointed teeth extending therefrom; and a pin portion attached to said attachment hub, and defined by a single elongate wire-shaped element terminating in a generally pointed tip and an attachment loop formed at and end opposing said pointed tip, said pin portion further defined by a proximal leg extending from said attachment hub, a medial leg extending from said proximal leg, and a distal leg extending from said proximal leg, with each said leg separated by a bend in said wire-shaped element, with said proximal and medial legs being non-parallel to said attachment hub face and said distal leg being generally parallel to said attachment hub face.

17. The device of claim 16, wherein said hub is defined by a grooved wall extending between said base portion rear face and said hub face, said grooved wall extending around the periphery of said attachment hub and defined by a concave groove formed therein, wherein said pin portion attaches to said grooved wall of said attachment hub.

* * * * *